US005778900A

United States Patent [19]

Bate

[11] Patent Number: 5,778,900

[45] Date of Patent: Jul. 14, 1998

[54] METHOD OF DECORATING FINGERNAILS

[76] Inventor: Jane M. Bate, 15083 Cleveland, Allen Park, Mich. 48101

[21] Appl. No.: 997,930

[22] Filed: Dec. 24, 1997

[51] Int. Cl.[6] ..... A45D 29/00

[52] U.S. Cl. ..... 132/73; 132/200

[58] Field of Search ..... 132/285, 200, 132/319, 73

[56] References Cited

U.S. PATENT DOCUMENTS

| | | | |
|---|---|---|---|
| 2,234,657 | 3/1941 | Smaldone | 132/285 |
| 3,993,084 | 11/1976 | Cullen | 132/73 |
| 4,157,095 | 6/1979 | Sweet | 132/73 |
| 4,299,243 | 11/1981 | Umstad | 132/73 |
| 5,150,726 | 9/1992 | Rucker | 132/73 |
| 5,209,250 | 5/1993 | Taeckns | 132/73 |
| 5,427,121 | 6/1995 | Polito | 132/285 |

*Primary Examiner*—Paul J. Hirsch

[57] ABSTRACT

A new method of decorating fingernails for styling nails in a multitude of attractive designs for longer wear. The inventive device includes a first step of applying a first coat of thick nail coverage to a fingernail. The second step involves cutting a piece of nail paper corresponding to the fingernail. The third step includes pressing the piece of nail paper onto the fingernail over the thick nail coverage. The fourth step includes working the piece of nail paper on the fingernail for a tight fit. The fifth step includes buffing all edges of the fingernail and the nail paper with a sponge file. The sixth step includes applying a first coat of epoxy over the piece of nail paper. The seventh step includes allowing the first coat of epoxy to dry. The eighth step includes applying a second coat of epoxy over the piece of nail paper. The final step includes allowing the second coat of epoxy to dry.

2 Claims, 2 Drawing Sheets

METHOD OF DECORATING FINGERNAILS

BACKGROUND OF THE INVENTION

1. Field of the Invention

The present invention relates to nail coatings and more particularly pertains to a new method of decorating fingernails for styling nails in a multitude of attractive designs for longer wear.

2. Description of the Prior Art

The use of nail coatings is known in the prior art. More specifically, nail coatings heretofore devised and utilized are known to consist basically of familiar, expected and obvious structural configurations, notwithstanding the myriad of designs encompassed by the crowded prior art which have been developed for the fulfillment of countless objectives and requirements.

Known prior art nail coatings include U.S. Pat. No. 3,993,084 to Cullen; U.S. Pat. No. 4,903,840 to So; U.S. Pat. No. Des. 346,464 to Romano; U.S. Pat. No. 4,947,876 to Larsen; U.S. Pat. No. 4,126,144 to Duarte; and U.S. Pat. No. 4,034,769 to Nishimura.

While these devices fulfill their respective, particular objectives and requirements, the aforementioned patents do not disclose a new method of decorating fingernails. The inventive device includes a first step of applying a first coat of thick nail coverage to a fingernail. The second step involves cutting a piece of nail paper corresponding to the fingernail. The third step includes pressing the piece of nail paper onto the fingernail over the thick nail coverage. The fourth step includes working the piece of nail paper on the fingernail for a tight fit. The fifth step includes buffing all edges of the fingernail and the nail paper with a sponge file. The sixth step includes applying a first coat of epoxy over the piece of nail paper. The seventh step includes allowing the first coat of epoxy to dry. The eighth step includes applying a second coat of epoxy over the piece of nail paper. The final step includes allowing the second coat of epoxy to dry.

In these respects, the method of decorating fingernails according to the present invention substantially departs from the conventional concepts and designs of the prior art, and in so doing provides an apparatus primarily developed for the purpose of styling nails in a multitude of attractive designs for longer wear.

SUMMARY OF THE INVENTION

In view of the foregoing disadvantages inherent in the known types of nail coatings now present in the prior art, the present invention provides a new method of decorating fingernails construction wherein the same can be utilized for styling nails in a multitude of attractive designs for longer wear.

The general purpose of the present invention, which will be described subsequently in greater detail, is to provide a new method of decorating fingernails apparatus and method which has many of the advantages of the nail coatings mentioned heretofore and many novel features that result in a new method of decorating fingernails which is not anticipated, rendered obvious, suggested, or even implied by any of the prior art nail coatings, either alone or in any combination thereof.

To attain this, the present invention generally comprises a first step of applying a first coat of thick nail coverage to a fingernail. The second step involves cutting a piece of nail paper corresponding to the fingernail. The third step includes pressing the piece of nail paper onto the fingernail over the thick nail coverage. The fourth step includes working the piece of nail paper on the fingernail for a tight fit. The fifth step includes buffing all edges of the fingernail and the nail paper with a sponge file. The sixth step includes applying a first coat of epoxy over the piece of nail paper. The seventh step includes allowing the first coat of epoxy to dry. The eighth step includes applying a second coat of epoxy over the piece of nail paper. The final step includes allowing the second coat of epoxy to dry.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new method of decorating fingernails apparatus and method which has many of the advantages of the nail coatings mentioned heretofore and many novel features that result in a new method of decorating fingernails which is not anticipated, rendered obvious, suggested, or even implied by any of the prior art nail coatings, either alone or in any combination thereof.

It is another object of the present invention to provide a new method of decorating fingernails which may be easily and efficiently manufactured and marketed.

It is a further object of the present invention to provide a new method of decorating fingernails which is of a durable and reliable construction.

An even further object of the present invention is to provide a new method of decorating fingernails which is susceptible of a low cost of manufacture with regard to both materials and labor, and which accordingly is then susceptible of low prices of sale to the consuming public, thereby making such method of decorating fingernails economically available to the buying public.

Still yet another object of the present invention is to provide a new method of decorating fingernails which provides in the apparatuses and methods of the prior art some of the advantages thereof, while simultaneously overcoming some of the disadvantages normally associated therewith.

Still another object of the present invention is to provide a new method of decorating fingernails for styling nails in a multitude of attractive designs for longer wear.

Yet another object of the present invention is to provide a new method of decorating fingernails which includes a first step of applying a first coat of thick nail coverage to a fingernail. The second step involves cutting a piece of nail paper corresponding to the fingernail. The third step includes pressing the piece of nail paper onto the fingernail over the thick nail coverage. The fourth step includes working the piece of nail paper on the fingernail for a tight fit. The fifth step includes buffing all edges of the fingernail and the nail paper with a sponge file. The sixth step includes applying a first coat of epoxy over the piece of nail paper. The seventh step includes allowing the first coat of epoxy to dry. The eighth step includes applying a second coat of epoxy over the piece of nail paper. The final step includes allowing the second coat of epoxy to dry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
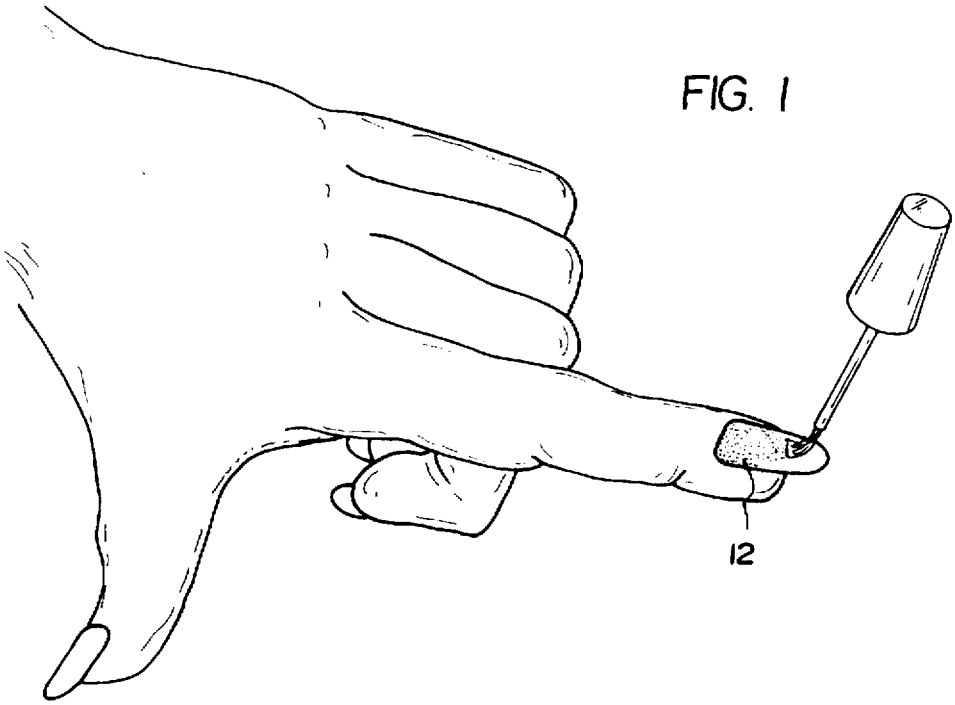
FIG. 1 is a perspective view of a new method of decorating fingernails according to the present invention illustrating the first step.
Figure 2:
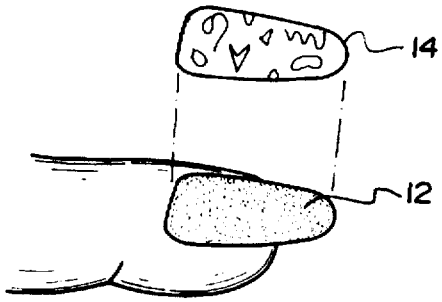
FIG. 2 is a perspective view of the third step of the present invention.
Figure 3:
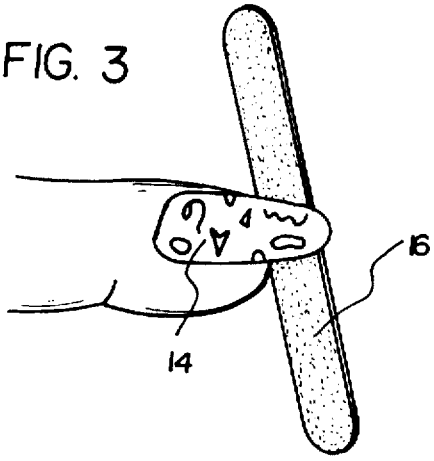
FIG. 3 is a perspective view of the fifth step of the present invention.
Figure 4:
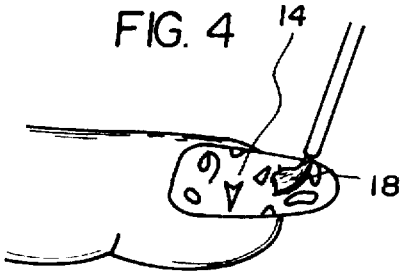
FIG. 4 is a perspective view of the sixth step of the present invention.
Figure 5:
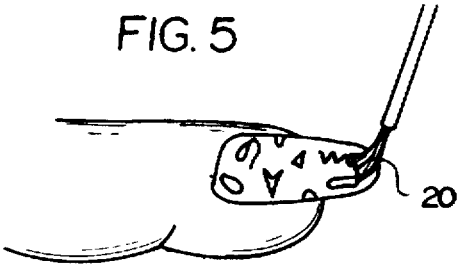
FIG. 5 is a perspective view of the final step of the present invention.

With reference now to the drawings, and in particular to FIGS. 1 through 5 thereof, a new method of decorating fingernails embodying the principles and concepts of the present invention and generally designated by the reference numeral 10 will be described.

As best illustrated in FIGS. 1 through 5, the method of decorating fingernails 10 comprises a first step of applying a first coat 12 of thick nail coverage to a fingernail. The second step involves cutting a piece of nail paper 14 corresponding to the fingernail. The nail paper 14 could also be a type of fabric. The nail paper 14 could be any color with designs incorporated therein. The third step includes pressing the piece of nail paper 14 onto the fingernail over the thick nail coverage. The fourth step includes working the piece of nail paper 14 on the fingernail for a tight fit. The fifth step includes buffing all edges of the fingernail and the nail paper 14 with a sponge file 16. The sixth step includes applying a first coat of epoxy or acrylic 18 over the piece of nail paper 14. The seventh step includes allowing the first coat of epoxy or acrylic 18 to dry. The eighth step includes applying a second coat of epoxy or acrylic over the piece of nail paper. The final step includes allowing the second coat of epoxy or acrylic to dry. The drying times for the epoxy or acrylic coatings is generally about one minute, but can vary depending on the amount of coverage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new method of decorating fingernails for styling nails in a multitude of attractive designs for longer wear comprising, in combination:

applying a coat of thick nail coverage to a fingernail;

cutting a piece of nail paper corresponding to the fingernail;

pressing the piece of nail paper onto the fingernail over the thick nail coverage;

working the piece of nail paper on the fingernail for a tight fit;

buffing all edges of the fingernail and the nail paper with a sponge file;

applying a first coat of epoxy over the piece of nail paper;

allowing first coat of epoxy to dry;

applying a second coat of epoxy over the piece of nail paper; and allowing second coat of epoxy to dry.

2. A new method of decorating fingernails for styling nails in a multitude of attractive designs for longer wear comprising, in combination:

applying a coat of thick nail coverage to a fingernail;

cutting a piece of nail fabric corresponding to the fingernail;

pressing the piece of nail fabric onto the fingernail over the thick nail coverage;

working the piece of nail fabric on the fingernail for a tight fit;

buffing all edges of the fingernail and the nail fabric with a sponge file; and applying a first coat of epoxy over the piece of nail fabric.

* * * * *